United States Patent [19]

Aiken

[11] Patent Number: 5,016,371

[45] Date of Patent: May 21, 1991

[54] SCROLLING SIGN APPARATUS

[76] Inventor: Robert B. Aiken, 1970 Bobolink Ave., Grafton, Wis. 53024

[21] Appl. No.: 190,034

[22] Filed: May 4, 1988

[51] Int. Cl.[5] ..... G09F 11/18

[52] U.S. Cl. ..... 40/518; 40/471

[58] Field of Search ..... 40/518, 519, 522, 523, 40/521, 471

[56] References Cited

U.S. PATENT DOCUMENTS

| | | | |
|---|---|---|---|
| 3,496,664 | 2/1970 | Gaffney et al. | 40/518 |
| 3,510,973 | 5/1970 | Mazzocco, Sr. | 40/471 |
| 3,754,342 | 8/1973 | Santacroce et al. | 40/472 X |
| 4,680,883 | 7/1987 | Stadjuhar et al. | 40/471 |

*Primary Examiner*—Kenneth J. Dorner
*Assistant Examiner*—J. Hakomaki
*Attorney, Agent, or Firm*—Andrus, Sceales, Starke & Sawall

[57] ABSTRACT

A scrolling sign apparatus is suitable for incorporation in existing sign enclosures. Brackets are inserted in the enclosure. A web and web roll assembly is removably fastened to the brackets. The web and web roll assembly includes a pair of spaced web rolls with a web extending between them. The web may extend between a pair of transparent sheets for displaying graphic or alpha-numeric information provided on the web. The information may be provided on separate sheets that are taped to the web.

18 Claims, 2 Drawing Sheets

SCROLLING SIGN APPARATUS

The present invention relates to an improved scrolling sign apparatus suitable for incorporation in existing sign enclosures so that graphic and/or alphanumeric information displayed in the sign may be easily and conveniently changed.

There are numerous applications in which it is desirable to change the message content of a sign. For example, in restaurants, particularly those of the fast food type, pricing and other information is displayed on a menu board sign. The menu board may be above the service counter, exterior to the restaurant, or elsewhere. All or a portion of the menu board may be back-lit to draw attention to the sign and increase legibility.

It would be desirable in restaurants of this type, to be able to change graphics, such as pictures of menu suggestions, and/or associated alpha-numeric information, such as descriptions or pricing, at various times. For example, these changes could occur at different times of day; as at breakfast, lunch, dinner; at different seasons; or for special events or promotions.

At present, existing menu boards use slip-in sheets for the graphics and individual characters or groups of characters for alpha-numeric information, such as product name and price. This makes changes difficult and prone to error. The sheets and characters must be stored before and after use and are subject to loss or damage.

It is, therefore, the object of the present invention to provide an improved scrolling sign apparatus that overcomes the foregoing shortcomings and permits information in a sign, such as a menu board, to be easily changed. The scrolling sign apparatus of the present invention may be retrofitted into existing sign enclosures to provide this feature without changing the enclosure or its external appearance. The scrolling sign apparatus is easily inserted and removed from the enclosure during installation, maintenance, or replacement.

The sign may employ graphic materials of the type utilized with conventional menu boards, while storing same in the scrolling sign apparatus. The graphic, as well as other informational materials, may be easily added to, or removed from, the apparatus. The graphic and/or other informational material are protected both during use and storage. The scrolling sign apparatus of the present invention includes means for manual operation in the event operation from a conventional power source, such as power mains, is not possible or desired. The scrolling sign apparatus of the present invention also lends itself to remote or automatic operation.

Briefly, the scrolling sign apparatus of the present invention includes bracket means suitable for insertion into an existing sign enclosure. The bracket means has a mounting portion. A web and web roll assembly has first and second spaced plates that are coupled together to form a frame for the assembly. The frame so formed is removably connected to the mounting portion of the bracket means. A pair of spaced web rolls are journalled for rotation in the plates. A web containing graphic or alpha-numeric information extends between the web rolls for being unwound and rewound on the rolls. An inner transparent or translucent sheet extends between the first and second plates intermediate the web rolls. An outer transparent sheet may be mounted on the first and second plates and is spaced from the inner sheet to form a gap through which the web extends between the rolls. Means are provided for rotating the web rolls to position the desired information between the inner and outer sheets for display purposes.

The graphic or alpha-numeric information is arranged in series along the web. The information can be printed on the web or may be on separate sheets attached to the web, as by tape or other suitable means. The information is stored on the web when wound on the rolls and the inner and outer transparent sheets protect the graphic or information material from deleterious factors such as dirt and ultraviolet light.

The invention will be more fully understood from the following detailed description, taken in conjunction with the drawing. In the drawing.

Figure 1:
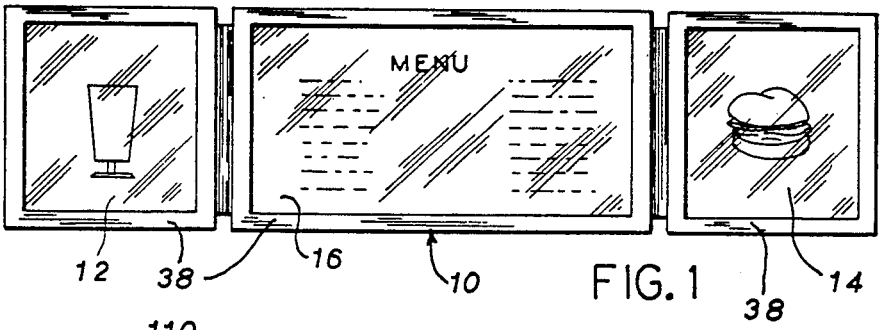
FIG. 1 shows a sign enclosure, such as a menu board, with which scrolling sign apparatus of the present invent be employed.
Figure 4:
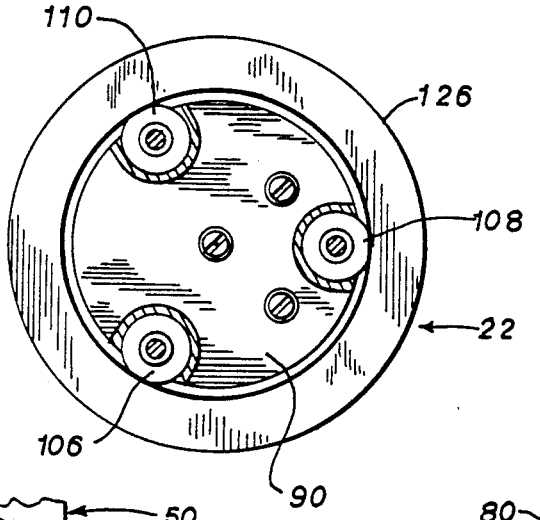
FIG. 4 is a view taken along the line 4—4 of FIG. 2.

FIG. 1 shows sign 10. Sign 10 may, for example, comprise a menu board for a restaurant. End panels 12 and 14 contain graphic displays of menu suggestions. Center panel 16 contains alpha-numeric information such as the description and price of menu items. Sign 10 may contain lights behind the panels for illuminating same.

In conventional signs, the graphic displays are provided on sheets of translucent material, such as plastic, that are illuminated by the lights in the sign. The sheets are slid into frames that surround and form the panels, such as 12 and 14. The alpha numeric information may be provided as individual characters, such as letters, or numbers or groups of characters, such as the name and/or price of a menu item. The characters rest on rails or other holders in center panel 16 and are suitable for being back lit. The graphic displays are changed by removing one sheet from the frame and inserting another sheet. The alphanumeric information is changed by exchanging the characters on the holders.

Figure 3:
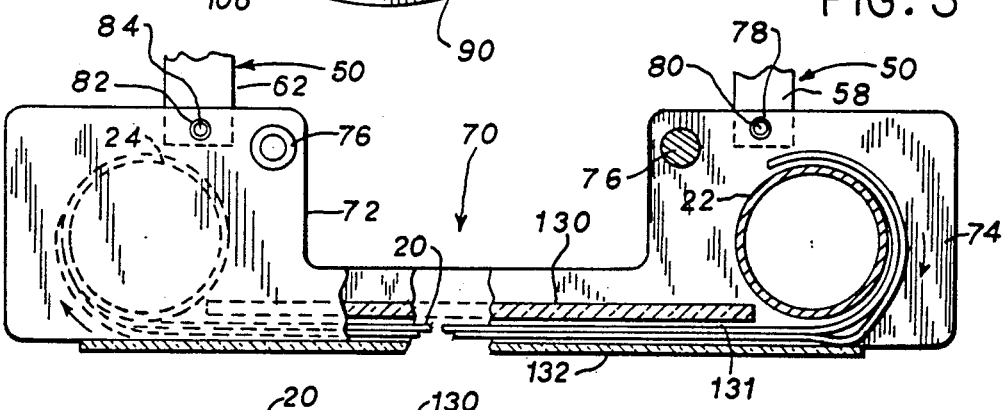
FIG. 3 is a generally horizontal cross sectional view of the scrolling sign apparatus of the present invention and showing its operation.

The scrolling sign apparatus of the present invention provides for changing information in a sign, such as a menu board, by scrolling a web 20 between two spaced web rolls 22 and 24 across one or more panels of sign 10, in the manner shown generally in FIG. 3. The graphic displays, such as menu suggestions, and/or alphanumeric information, such as menu item descriptions and prices, are provided on the web. The web is unwound from one roll and wound up on the other roll to move the desired information into the panel(s) for display purposes.

Figure 2:
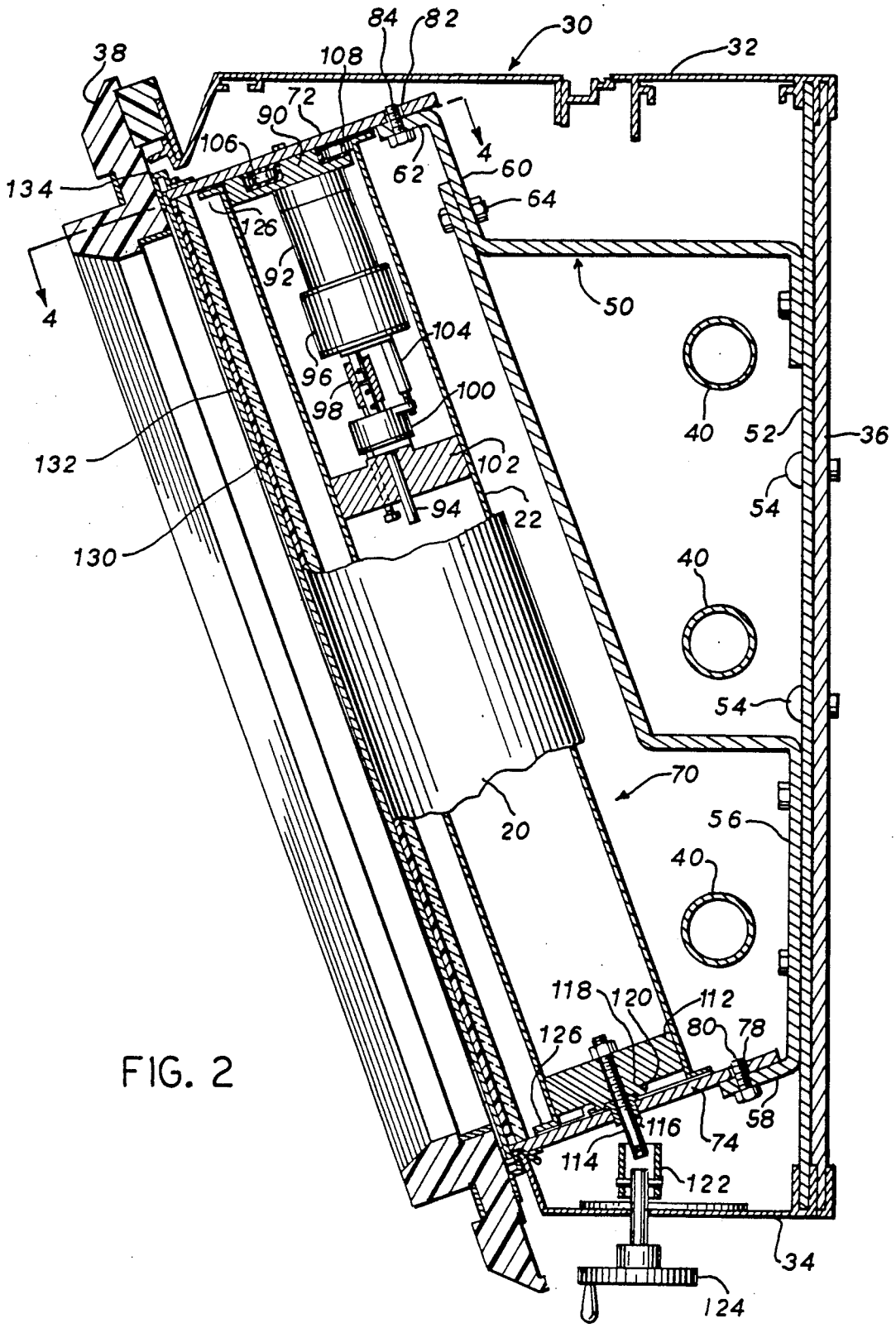
FIG. 2 is a generally vertical cross sectional view through the sign enclosure showing the scrolling sign apparatus of the present invention.

FIG. 2 shows details of the scrolling sign apparatus of the present invention. Sign 10 includes an enclosure 30 having upper wall 32, lower wall 34 and back wall 36. The front of enclosure 30 includes removable frames 38 that surround the panels in sign 10. Enclosure 30 typically contains lights 40 of the fluorescent type for back lighting the sign.

The scrolling sign apparatus of the present invention includes horizontally spaced brackets 50 for mounting the apparatus in enclosure 30. One such bracket 50 is shown in detail in FIG. 2. Bracket 50 includes strap 52, the upper and lower ends of which abut upper and lower walls 32 and 34, respectively, of enclosure 30. If desired, strap 52 may be joined to back wall 36 of enclosure 30 by any suitable means 54, such as nuts and bolts, expandable rivets, and the like. Bracket 50 includes lower support member 56, fastened to strap 52, and having flange 58 at the lower end thereof. Bracket 50 also includes upper support member 60 fastened to strap 52 and having flange 62 at the upper end thereof. Support members 56 and 60 may be joined together in their overlapping portions as by bolt and nut 64, spot welding, or other suitable means. The use of brackets 50 permits retrofitting the scrolling sign apparatus into existing sign enclosures.

The scrolling sign apparatus of the present invention also includes a web and web roll assembly 70 mounted to brackets 50. The web and web roll assembly 70 contains web 20 and web rolls 22 and 24. The web roll assembly includes upper and lower plates 72 and 74 in which the web rolls are journalled for rotation. Upper and lower plates are joined together by rods 76, shown in FIG. 3, to form the plates into a frame for assembly 70. Lower plate 74 contains holes 78. Bolts 80, threaded through flanges 58 on lower support members 56, extends into holes 78. Upper plate 72 contains holes 82. Bolts 84 threaded through flanges 62 on upper support members 62 extends into holes 82. In this manner, web and web roll assembly 70 is mounted on brackets 50 and, hence in enclosure 10. The web and web roll assembly avoids interference with lights 40 yet is properly positioned with respect to them. The web and web roll assembly can be easily removed from enclosure 10 for maintenance or other purposes, by flexing brackets 58 and 62 to remove bolts 80 and 84 from holes 78 and 82, and sliding assembly 70 out of enclosure 10. The process is reversed during installation of the assembly.

The web rolls 22 and 24 are mounted for rotation on upper and lower plates 72, 74. FIGS. 2 and 3 show the manner of such mounting for web roll 22. Motor mounting bracket 90 is mounted on the lower surface of upper plate 72 to mount motor 92. Motor 92 rotates output shaft 94 through speed reducing gear box 96. Output shaft 94 extends through universal joint 98 to the rotor of clutch 100. Output shaft 94 is rotatably journalled in plug 102 for supporting the shaft while permitting relative rotation between the shaft and the plug. Plug 102 is affixed to the inner wall of roll 22. The housing of clutch 100 is non-rotatably retained on the housing of motor 92 by bar 104.

Clutch 100 may be of the electrically operated type having a low voltage field coil that serves, when energized, to couple a rotor mounted on shaft 94 with an armature drivingly connected to plug 102 to cause shaft 94 to rotate plug 102 and web roll 22. When the field coil is deenergized, driving engagement of the armature with the rotor is lost and the shaft does not drive plug 102 and web roll 22. A clutch suitable for use in the scrolling sign apparatus of the present invention is that manufactured and sold by Warner Electric Brake and Clutch Co. of South Beloit, Ill. under the designation SF-120 or XA-104-10-025. Further details of such clutches are provided in published patent application WO 87/07745, published Dec. 17, 1987 and in allowed U.S. patent application Ser. No. 871,072, filed June 5, 1986, now U.S. Pat. No. 4,741,118.

The use of a motor and clutch internal to the web rolls provide a compact construction to the scrolling sign apparatus that permits retrofitting in a wide variety of enclosures and minimizes interference with other components, such as lights 40.

As shown most clearly in FIG. 3, motor mounting bracket 90 contains rollers 106, 108, and 110 to support and guide the upper end of web roll 22. The lower end of web roll 22 contains plug 112 having axle 114 journalled in bearing 116 in lower plate 74.

Roll 22 may be provided with a braking means that provides a greater amount of braking or retarding action when the web is being unwound from web roll 22 than when it is being rewound onto the web roll. This prevents free wheeling of the web rolls during operation of the scrollings sign apparatus. To this end, plug 112 may include collar 118 containing a groove. A spring wire 120 bent in a generally circular fashion is provided in the groove, to embrace the collar. An end of the spring wire is anchored in lower plate 74. The differential braking action is obtained by the tendency of the spring to wrap around collar 118 in one direction of rotation but not in the other. The braking means is further described in the aforesaid published PCT application and allowed U.S. application.

In the event it is not desired to drive the web rolls 22 and 24 from the associated motors 92, means are provided to manually rotate the web rolls. Specifically, axle 114 is coupled through coupler 122 to hand crank 124 extending through lower wall 34 of enclosure 30.

Web roll 22 contains upper and lower flanges 126 to assist in guiding and retaining web 20 on the web rolls.

The construction of web roll 24 resembles that of the web roll 22 described, in detail, above.

Light transmitting sheet 130 extends between upper and lower plates 72 and 74 along the front of the scrolling sign apparatus and intermediate web rolls 22 and 24. Sheet 130 may be formed of a material, such as transparent or translucent plastic, and can be fastened to the upper and lower plates by screws extending through the plates and into the edges of the sheet. Exterior sheet 132 may be spacedly mounted on plates 72 and 74 with respect to sheet 130 to provide a spacing or gap 131 between the sheets through which web 20 extends. Sheet 132 is formed of a transparent material, such as plastic. Sheets 130 and 132, lying on both sides of web 20, serve to encapsulate web 20 and protect it from dirt and other deleterious factors when the web is displayed in frame 38. Sheet 132 may be affixed to upper and lower end plates 72 and 74 by clips, one of which is shown in FIG. 2 at 134. The periphery of sheet 132 may be rendered opaque, as by painting, to serve as a mask and prevent light leaks around frame 38.

Web 20 may be formed of a flexible transparent or translucent plastic, such as polycarbonate or other suitable material. Polycarbonate plastic material is advantageous in that it can act as a filter of the ultraviolet light of lights 40 for information placed on the front side of web 20. The graphic displays or alpha-numeric information to be displayed in sign 10 may be printed directly on web 20 and, preferably the front side thereof. Or, the graphic or informational materials may be printed on separate sheets 140 that are attached to web 20. This permits the graphic or informational materials to be applied to, and removed from, the web as desired. Or, portions of web 20 may contain printed materials, such as standard displays or information, and other portions of the web left blank to permit the attachment of separate sheets 140 showing special or seasonal items.

Figure 5:
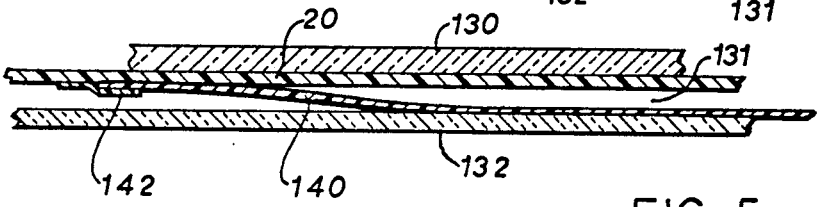
FIG. 5 is a fragmentary view also showing operation of the scrolling sign apparatus of the present invention.

FIG. 5 shows one manner of fastening separate sheets 140 to web 20. Web 20 has separate sheet 140 containing graphic or alpha-numeric information applied to the surface facing exterior sheet 132. Sheet 140 may be held on web 20 by an adhesive tape 142. To affix the sheet 140 to web 20, one end of the sheet 140 is taped to web 20. The web 20 and sheet 140 are rolled up on one of the web rolls. The remaining end of sheet 140 is then taped to the web. Sheet 140 may be removed by loosening the tape. The foregoing arrangement permits the scrolling sign apparatus of the present invention to use the same graphics or informational sheets that are commonly used in signs of the non-scrolling type. Or, thinner, less expensive sheets may be used because of the support provided to the sheets by web 20.

Other means, for example resilient filamentary hook and eye fastener strips (Velcro) or deformable plastic fastening strips (Ziplock) may be used, if desired.

The surfaces of sheets 130 and 132, web 20, and sheets 140 that are likely to come in contact during operation of the scrolling sign apparatus may be formed of abrasion resistant material or may be provided with an abrasion resistent coating, if desired.

Because of the different radii of web 20 and sheet 140 when rolled up on the web rolls, when web 20 is flat in the gap 131 between plates 130 and 132, as shown in FIG. 5, sheet 140 will have a slight bulge. This is accommodated in gap 131, as by a minor bending or buckling of the sheet.

As shown in FIG. 3, the end configuration of sheets 130 and 132 is such to insure that tape 142 and any bulges in separate sheet 140 as web 20 is unwound can be accommodated during the unrolling process. For this purpose plate 132 extends beyond plate 130 and beyond the point of tangency with rolls 22 and 24 in the manner shown in FIG. 3. This insures that tape 142 and any bulges in sheet 140 will strike the flat surface of sheet 132 rather than its edge and will slide into gap 131 between sheets 130 and 132.

In operation, motors 92 are energized to rotate output shafts 94. One or the other of clutches 100 is energized to rotate one of web rolls 22 or 24 in a direction that causes the web 20 to be wound up on that web roll. The web is unwound from the other web roll. The differential braking action provided by spring wire 120 on collar 118 insures that, particularly the unwinding roll does not free wheel. The surface contact of web 20 with a sheet 130 maintains tension in web 20. When the information on web 20 is positioned in the desired location in sign 10, the clutch 100 is deenergized so that the desired material remains in the panel(s) of the sign. Motors 92 may then be deenergized.

Or, hand crank 124 may be operated to move the web into the desired position. The differential braking action provided by spring wire 120 and groove 118 tends to permit the hand cranks 124 to be operated in the windup direction only. If more positive action is desired or required, one way clutches or ratchets may be interposed between hand cranks 124 and rolls 22 and 24 to insure operation only in the windup direction. This avoids slack in web 20. Where solely manual operation is desired, motors 92 and the attendant elements can be omitted and the upper ends of rolls 22 and 24 provided with shafts journalled in plate 72.

It will also be appreciated that, if desired, the operation of motors 92 and clutches 100 may be automated to any desired extent. Thus, web 20 or sheet 140 may be provided with appropriate indexing or coding marks that coact with optical scanning means so that movement of web 20 stops when the desired information is displayed in the sign. Or, a simple indexing mark may be provided on web 20 that indicates the position of the web with respect to frame(s) 38. A jog-type control is used to step the desired graphics into frame(s) 38 by watching the movement of web 20 in sign 10. Or, the movement of web 20 may be controlled by a clock to display certain information at certain times of the day. The movement of web 20 in sign 10 may be such that a desired information is moved into sign 10, remains in the frame for a predetermined period of time, is moved out of sign 10, and replaced with different information. The winding direction of web 20 and web rolls 22 and 24 may be automatically reversed when the web approaches the completely unwound state on one or the other of the web rolls.

Various modes of carrying out the invention are contemplated as being within the scope of the following claims particularly pointing out and distinctly claiming the subject matter which is regarded as the invention.

I claim:

1. A scrolling sign apparatus suitable for incorporation in a sign enclosure having one or more of an upper wall, back wall, and lower wall, said enclosure having means formed in the interior thereof capable of engaging parts of said apparatus for retaining same in the enclosure, said apparatus comprising:

bracket means positionable within said enclosure, said bracket means having an upper arm portion, a lower arm portion, and an intermediate portion extending between said upper and lower arms, said intermediate portion having parts formed for engaging the means in the interior of the enclosure for positioning and retaining said bracket means within the enclosure; and a web and web roll assembly comprising:

first and second spaced plates, said plates being coupled together to form a frame for said assembly, said assembly being removably connected to said upper arm portion and to said lower arm portion so that one of said first and second plates lies above said upper arm portion and the other of said first and second plates lies above said lower arm portion, said assembly being positioned within the sign enclosure when said assembly is connected to said arms, said bracket means being formed such that the portions of said assembly adjacent said upper arm portion are tilted toward a viewer of the sign, a pair of spaced web rolls journalled for rotation in said plates, a web extending between said web rolls for being unwound and rewound on said rolls, said web being suitable for having informational material arranged in series therealong, means for rotating said web rolls to unwind and rewind said web, and an inner sheet extending between said first and second spaced plates and over which said web travels between said rolls.

2. THe scrolling sign apparatus according to claim 1 further including an outer transparent sheet mounted on said first and second plates, said outer sheet being spaced from said inner sheet to form a gap through which said web extends between said rolls, the information being displayed through said outer sheet.

3. The scrolling sign apparatus according to claim 1 wherein said web is transparent or translucent.

4. The scrolling sign apparatus according to claim 1 wherein said informational material is printed on said web.

5. The scrolling sign apparatus according to claim 1 wherein said apparatus further includes at least one sheet containing said informational material, said informational material sheet being applied on said web.

6. The scrolling sign apparatus according to claim 5 wherein said informational material sheet is so mounted on said web that said web and sheet can be rolled up tightly on said rolls.

7. The scrolling sign apparatus according to claim 5 wherein said informational material sheet is so mounted on said web that any slack occurring when said web and sheet are unwound from said rolls occurs in said sheet.

8. The scrolling sign apparatus according to claim 5 wherein said informational material sheet is fastened to said web by an adhesive tape.

9. The scrolling sign apparatus according to claim 1 wherein said means for rotating said web rolls comprise motor-clutch means internal to said web rolls.

10. The scrolling sign apparatus according to claim 1 said means for rotating said web rolls comprises means for manually rotating said web rolls.

11. The scrolling sign apparatus according to claim 1 further including means for preventing said web rolls from free wheeling.

12. The scrolling sign apparatus according to claim 1 wherein the means formed in the interior of the enclosure comprises slots and wherein said intermediate portion has strap-like parts extending therefrom and formed for insertion in the slots.

13. A scrolling sign apparatus suitable for incorporation in a sign enclosure, said apparatus comprising:

bracket means positionable in said enclosure; and a web and web roll assembly comprising:

first and second spaced plates, said plates being coupled together to form a frame for said assembly, said frame being connected to said bracket means;

web transport means including a pair of spaced web rolls journalled for rotation in said plates;

a web extending between said web rolls for being unwound and rewound on said rolls, said web moving along a path extending between said rolls, said web being formed of a dimensionally stable material, said web having at least one sheet of flexible, dimensionally stable material applied thereto, said sheet containing informational material, said sheet having ends that are spaced in the direction of the path of the web, said ends being affixed to said web in a manner that does not allow displacement of the ends of the sheet with respect to the web along the web, the spacing of the points of affixation of said ends of said sheet to said web being such that slack will occur in said sheet when said web and sheet are unwound from said rolls allowing the sheet to bow away from the surface of the web to which the ends of the sheet are affixed, the spacing of the ends of the sheet further being such that said web and sheet lie smoothly when rewound on a roll in a spiral, the radius of which increases generally uniformly as the web and sheet are rewound on the roll;

means for rotating said web rolls to unwind and rewind said web; and an inner sheet extending between said first and second spaced plates.

14. The scrolling sign apparatus according to claim 13, further including an outer transparent sheet mounted on said first and second plates proximate to said web rolls, said outer transparent sheet being spaced from said inner sheet to form a gap through which said web extends between said rolls, said gap being formed to facilitate movement of said web between said rolls.

15. The scrolling sign apparatus according to claim 14, wherein said web extends between said rolls from points of tangency on said web transport means, said outer sheet extending beyond the point of tangency of said web with web transport means to insure that said web and sheet enter said gap when being unwound from said rolls.

16. The scrolling sign apparatus according to claim 13 wherein said dimensionally stable flexible sheet is fastened to said web by suitable means.

17. The scrolling sign apparatus according to claim 16, wherein said dimensionally stable flexible sheet is fastened to said web by an adhesive tape.

18. The scrolling sign apparatus according to claim 1 further including suitable means for fastening said informational material sheet to said web.

* * * * *